United States Patent [19]

Brown

[11] Patent Number: 4,462,945

[45] Date of Patent: Jul. 31, 1984

[54] CONTROL MECHANISM FOR A CARBURETOR

[75] Inventor: Peter W. Brown, North Muskegon, Mich.

[73] Assignee: Outboard Marine Corporation, Waukegan, Ill.

[21] Appl. No.: 134,129

[22] Filed: Mar. 26, 1980

[51] Int. Cl.[3] ..... F02M 1/02

[52] U.S. Cl. ..... 261/50 R; 261/64 E; 261/71

[58] Field of Search ..... 261/64 E, DIG. 68, 71, 261/50 R

[56] References Cited

U.S. PATENT DOCUMENTS

| | | | |
|---|---|---|---|
| 1,177,318 | 3/1916 | Goldberg | 261/64 E |
| 1,556,179 | 10/1925 | Titman | 261/64 E |
| 1,605,280 | 11/1926 | Rayfield | 261/64 E |
| 2,264,365 | 12/1941 | Conover | 261/71 |
| 2,744,736 | 5/1956 | Evinrude | 261/64 E |
| 2,791,207 | 5/1957 | Rayniak | 261/39 R |
| 2,951,690 | 9/1960 | Eberline | 261/71 |
| 3,275,029 | 9/1966 | Wellman | 74/502 |
| 3,309,068 | 3/1967 | Nierode | 261/DIG. 68 |
| 3,355,960 | 12/1967 | Bureck et al. | 74/504 |
| 4,001,355 | 1/1977 | Day | 261/71 |

FOREIGN PATENT DOCUMENTS

| | | | |
|---|---|---|---|
| 599584 | 10/1925 | France | 261/71 |

*Primary Examiner*—Tim R. Miles

*Attorney, Agent, or Firm*—Michael, Best & Friedrich

[57] ABSTRACT

A carburetor comprises an air induction passage and a choke valve movable in the air induction passage. The carburetor also includes a fuel chamber and a fuel inlet valve which controls the introduction of fuel into the chamber. A control rod is operative for movement axially along and rotationally about its longitudinal axis. The control rod is operatively linked with both the choke valve and the fuel inlet valve such that movement of the control rod in one of its axial and rotational directions operates the choke valve and movement of the control rod in the other one of the axial and rotational directions operates the fuel inlet valve.

9 Claims, 5 Drawing Figures

CONTROL MECHANISM FOR A CARBURETOR

FIELD OF THE INVENTION

The invention generally relates to carburetors for internal combustion engines and, more particularly, to mechanisms which control the choke valves and fuel valves associated with carburetors.

DESCRIPTION OF THE PRIOR ART

Attention is directed to the following U.S. Pat. Nos. which generally disclose control mechanisms utilizing a single control rod: Wellman 3,275,029, Sept. 27, 1966, Bureck et al 3,355,960, Dec. 5, 1967.

SUMMARY OF THE INVENTION

The invention provides a carburetor comprising an air induction passage and a choke valve movable in the air induction passage. The carburetor further includes a fuel chamber and a fuel inlet valve which is selectively operable for controlling the introduction of fuel from a source into the fuel chamber. Control means having an axis is also provided, the control means being operative for movement axially along and rotationally about its axis. Linkage means operatively connects the control means with the choke valve and the fuel inlet valve for operating the choke valve in response to one of the axial and rotational movements of the control means and for operating the fuel inlet valve in response to the other one of the axial and rotational movements of the control means.

In one embodiment, the choke valve is rotatably movable between fully opened and fully closed positions about an axis which is disposed perpendicularly to the control means axis. In this embodiment, the fuel inlet valve is rotatably operative between on and off positions about an axis which is disposed parallel to the control means axis. In this arrangement, the linkage means includes means for rotatably moving the choke valve in response to the axial movement of the control means and means for rotatably moving the fuel inlet valve in response to the rotational movement of the control means.

In one embodiment, the linkage means includes an overcenter mechanism which yieldably biases the choke valve toward its fully open position when the control means is in a range of axial positions on one side of a predetermined axially centered position and yieldably biases the choke valve toward its fully closed position when the control means is in a range of axial positions on the opposite side of the axially centered position.

One of the principal features of the invention is a carburetor having a control mechanism which independently controls both the position of the carburetor choke valve and the position of the associated carburetor fuel inlet valve.

Another one of the principal features of the invention is the provision of a carburetor having a control mechanism which is rotated to open and close the fuel supply valve and is operated in a push-pull fashion to actuate the choke valve.

Other features and advantages of the embodiments of the invention will become known by reference to the following general description, claims, and drawings.

DRAWINGS

Figure 1:
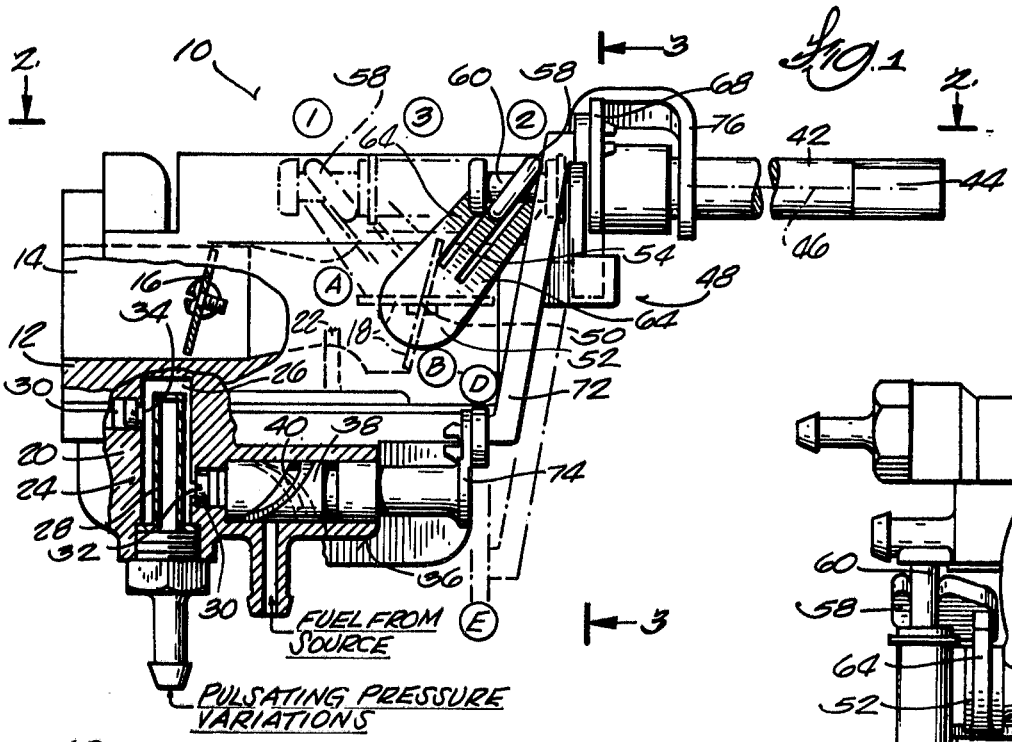
FIG. 1 is a side and partially broken away view of a carburetor which embodies various of the features of the invention.

Before explaining the embodiments of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in FIG. 1 is a carburetor 10 which includes a housing 12 and an air induction passage 14 extending through the housing 12. A throttle valve 16 and a choke valve 18 are carried for movement in the air induction passage 14. In particular, the choke valve 18 is movable between a fully opened position (shown as phantom line position A in FIG. 1) and a fully closed position (shown as phantom line position B in FIG. 1).

The carburetor 10 also includes a fuel or float chamber 20 which communicates with a source of fuel (not shown) as well as with the air induction passage 14, typically through a fuel metering orifice 22. A fuel pump 24 (see FIG. 1) pumps fuel from the source into the float chamber 20.

While various constructions are possible, in the illustrated embodiment the fuel pump 24 is a pulse-activated type, including a fuel chamber 26 in which a flexible bladder 28 is located. The bladder 28 communicates with a source of pulsating pressure variations, such as those occurring in an engine crankcase during piston reciprocation. As a result, the bladder 28 pulsates to change the volume of the chamber 26. Check valves 30 are provided at the inlet and outlet ends 32 and 34 of the fuel chamber 26 to channel the fuel in a single direction from the source into the carburetor float chamber 20 in response to bladder pulsation.

A fuel inlet valve 36 is located upstream of the inlet end 32 of the fuel pump 24 to control the introduction of fuel into the float chamber 20. While various constructions are possible, in the illustrated embodiment (see FIG. 1), the fuel inlet valve 36 is operable between rotationally spaced off and on positions to respectively block and permit the flow of fuel through the pump 24.

More particularly, in the illustrated embodiment, the fuel inlet valve 36 includes a rotary spool member 38 which carries a diagonal O-ring 40 or the like. When the valve 36 is in its off position (as shown in solid lines in FIG. 1), the spool member 38 is located so that the O-ring 40 blocks communication between the source and the fuel pump 24. When the valve 36 is in its on position (as shown in phantom lines in FIG. 1), the spool member 38 is located so that the O-ring 40 affords communication between the source and the fuel pump 24.

A control rod 42 having a handle end 44 is provided to control the operative positions of both the choke valve 18 and the fuel inlet valve 36. While various constructions are possible, the control rod 42 has an axis 46 and is mounted on the carburetor housing 12 for movement both axially along and rotationally about its axis 46. In the illustrated embodiment, the axis 46 extends parallel to the axis of rotation of the fuel inlet valve 36 and perpendicularly to the axis of rotation of the choke valve 18.

Linkage means 48 operatively connects the control rod 42 with the choke valve 18 and the fuel inlet valve 36 for operating the choke valve 18 in response to one of the axial and rotational movements of the control rod 42 and for operating the fuel inlet valve 36 in response to the other one of the axial and rotational movements of the control knob 42.

In the particular embodiment illustrated, the linkage means 48 is arranged so that rotation of the control rod 42 opens and closes the fuel inlet valve 36, and axial or "push-pull" movement of the control rod 42 operates the choke valve 18. However, in an alternate embodiment, the linkage means 48 could be oppositely arranged so that rotation of the control rod 42 operates the choke valve 18 and axial movement actuates the fuel inlet valve 36.

Reference is made first to the specific operation of the choke valve 18 as controlled by the rod 42. In the illustrated embodiment, the control rod 42 is movable between axially spaced first and second positions (shown in FIG. 2, respectively, as solid line position 1 and phantom line position 2) through an intermediate or center position (phantom position 3 in FIG. 2). These three positions are generally indicated by the same number progression in FIG. 1.

Figure 2:
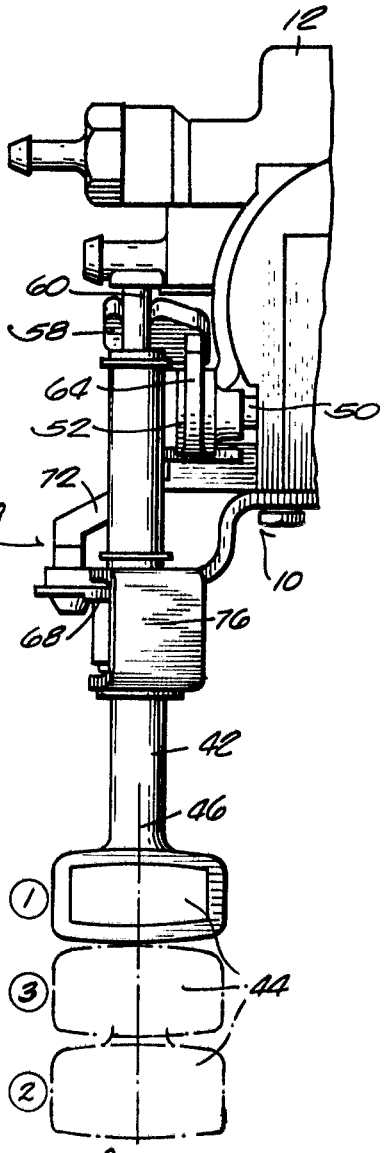
FIG. 2 is a top view of the carburetor generally taken along line 2—2 of FIG. 1.
Figure 4:
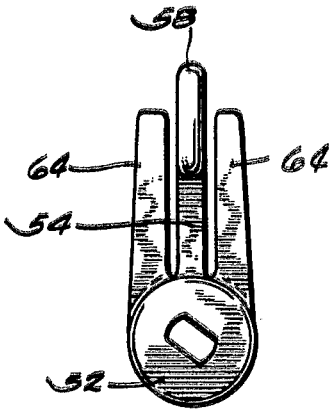
FIG. 4 is an end elevational view of one of the components of the carburetor shown in FIG. 1.
Figure 5:
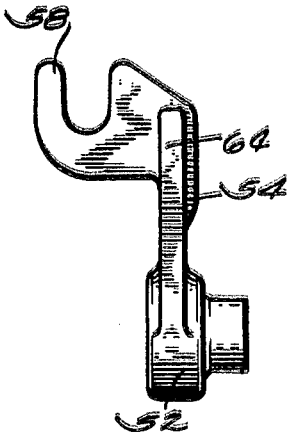
FIG. 5 is a side elevational view of the component shown in FIG. 4.

As can be seen in FIGS. 1 and 2, the linkage means 48 in the illustrated embodiment includes a lever arm 52 which is coupled to the shaft 50 of the choke valve 18 and which is operatively connected with the control rod 42 so that axial or push-pull movement of the control rod 42 is translated into rotation of the choke valve 18.

By virtue of this arrangement, when the control rod 42 is in its first axially spaced position (phantom line position 1 in FIG. 1), the choke valve 18 is in its fully opened position (phantom position A in FIG. 1). Conversely, when the control rod 42 is in its second axially spaced position (solid line position 2 in FIG. 1), the choke valve 18 is in its fully closed position (phantom line position B in FIG. 1).

In the illustrated embodiment (see FIGS. 1 and 2), the lever arm 52 associated with the choke valve 18 includes an overcenter spring in the form of a flexibly resilient member 54 having a forked end 58 (see FIG. 2) which snugly rests in a groove 60 formed on the end of the control rod 42. As is best shown in FIG. 1, the member 54 is in a relaxed or unflexed state when the control rod 42 is in either its first or second axially spaced positions. However, movement of the control rod 42 from either of its first or second axially spaced positions toward its center position (position 3 in FIGS. 1 and 2) elastically bends or flexes the member 54. This causes a torque which serves to yieldably bias the choke valve 18 toward its fully open position whenever the control rod 42 is on the first position side of its center position (that is, between positions 1 and 3 in FIGS. 1 and 2), and toward its fully closed position when the control rod 42 is on the second position side of its center position (that is, between positions 2 and 3 in FIGS. 1 and 2). Fingers 64 are provided so that the flexing of the resilient member 54 is confined to only one plane.

Reference is now made to the operation of the fuel inlet valve 36 as controlled by the rod 42. In the illustrated embodiment, the control rod 42 is movable between rotationally spaced first and second positions (shown in FIG. 3 respectively as solid line positions D and phantom line position E).

Figure 3:
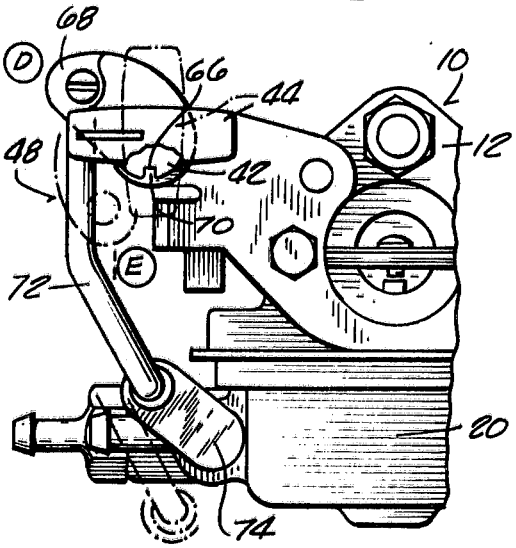
FIG. 3 is an end view of the carburetor generally taken along line 3—3 of FIG. 1.

Still referring to FIG. 3, the linkage means 48 in the illustrated embodiment includes an axially extending keyway 66 in the control rod 42 and a lever arm 68 having a key 70 which is engagable in the keyway 66. The linkage means 48 also includes another lever arm 74 which is operatively coupled for common rotation with the spool member 38 of the fuel inlet valve 36 (see also FIG. 1), as well as a link member 72 which operatively couples the two lever arms 68 and 74 together for rotation in common with rotation of the control rod 42.

By virtue of this construction, rotation of the control rod 42 is translated into rotation of the spool member 38. More particularly, when the control rod 42 is in its first rotationally spaced position (solid line position D in FIG. 3), the fuel inlet valve 36 is in its off position (as is also shown in solid lines in FIG. 1). Likewise, when the control rod 42 is in its second rotationally spaced position (phantom line position E in FIG. 3), the fuel inlet valve 36 is situated in its on position (as is also shown in phantom lines in FIG. 1).

The axially extending keyway 66 in the control rod 42 transmits rotational movement of the control rod 42 to lever arm 68 and thence to lever arm 74 through connecting link member 72 to operate the rotary fuel inlet valve 36. However, the keyway 66 still permits axial movement of the control rod 42 along axis 46 and relative to the lever arm 68 to operate the choke valve 18. A collar 76 (see FIGS. 1 and 2) on the control rod 42 restrains any axial movement or sliding of the lever arm 68 during such axial movement of the control rod 42. The choke valve 18 can thus be operated in response to push-pull movement of control rod 42, regardless of the rotational position of the control rod 42. Likewise, the fuel inlet valve 36 can be operated in response to rotational movement of the control rod 42 regardless of particular axial position of the control rod 42.

Various of the features of the invention are set forth in the following claims.

I claim:

1. A carburetor comprising an air induction passage, a choke valve operatively movable in said air induction passage, a float bowl, a fuel inlet valve selectively operable for controlling introduction of fuel from a source into said float bowl, means including an orifice communicating between said float bowl and said air induction passage, control means having an axis and operative for movement axially along and rotationally about said axis, and linkage means operatively connecting said control means with said choke valve and said fuel inlet valve for operating said choke valve in response to one of the axial and rotational movements of said control means and for operating said fuel inlet valve in response to the other one of the axial and rotational movements of said control means.

2. A carburetor according to claim 1 wherein said linkage means includes means for operating said choke valve in response to the axial movement of said control means and means for operating said fuel inlet valve in response to the rotational movement of said control means.

3. A carburetor according to claim 1 wherein said choke valve is rotatably movable about an axis disposed perpendicularly to said axis of said control means.

4. A carburetor according to claim 1 or 3 wherein said fuel inlet valve is rotatably operable about an axis disposed parallel to said axis of said control means.

5. A carburetor according to claim 1 wherein said choke valve is movable in said air induction passage between a fully opened position and a fully closed position, wherein said control means is movable between axially spaced first and second positions, and wherein said linkage means includes means operative for moving said choke valve between said fully opened position and said fully closed position in response to movement of said control means between said first and second axially spaced positions.

6. A carburetor comprising an air induction passage, a choke valve operatively movable in said air induction passage, between a fully opened position and a fully closed position, a fuel chamber, a fuel inlet valve selectively operable for controlling introduction of fuel from a source into said fuel chamber, control means having an axis and being movable axially between axially spaced first and second positions, and through a center position intermediate said axially spaced first and second positions, said control means also being rotationally movable about said axis, and linkage means operatively connecting said control means with said choke valve and said fuel inlet valve for operating said choke valve between said fully opened position and said fully closed position in response to movement of said control means between said first and second axially spaced positions, and for operating said fuel inlet valve in response to rotational movement of said control means, said linkage means including over-center means for alternatively yieldably biasing said choke valve from an unstable center position toward said fully opened position when said control means is on said first position side of said center position and toward said fully closed position when said control means is on said second position side of said center position.

7. A carburetor according to claim 1 or 5 wherein said fuel inlet valve is operative between an on position for permitting the introduction of fuel from the source into said float bowl and an off position for preventing the introduction of fuel from the source into said float bowl, wherein said control means is movable between rotationally spaced first and second positions, and wherein said linkage means includes means operative for moving said fuel inlet valve between said on position and said off position in response to movement of said control means between said first and second rotationally spaced positions.

8. A carburetor according to claim 7 wherein said fuel inlet valve includes a spool valve member rotatably movable between said on position and said off position in response to movement of said control means between said first and second rotationally spaced positions.

9. A carburetor comprising an air induction passage, a choke valve operatively movable in said air induction passage, a float bowl, a fuel inlet valve selectively operable for controlling introduction of fuel from a source into said float bowl, means including an orifice communicating between said float bowl and said air induction passage, control means having an axis and operative for movement axially along and rotationally about said axis, and linkage means operatively connecting said control means with said choke valve and said fuel inlet valve for operating said choke valve in response to one of the axial and rotational movements of said control means and regardless of the position of said control means in relation to the other of said movements, and for operating said fuel inlet valve in response to said other one of the axial and rotational movements of said control means and regardless of the position of said control means in relation to said one of said movements.

* * * * *

UNITED STATES PATENT AND TRADEMARK OFFICE

CERTIFICATE OF CORRECTION

PATENT NO. : 4,462,945

DATED : July 31, 1984

INVENTOR(S) : Peter W. Brown, et al.

It is certified that error appears in the above-identified patent and that said Letters Patent is hereby corrected as shown below:

Title page, "Inventor: Peter W. Brown, North Muskegon, Mich." should be -- Inventors: Peter W. Brown, North Muskegon, Mich., Chester G. DuBois, Zion, Ill., David J. Hartke, Waukegan, Ill., and Paul R. Hunt, Lindenhurst, Ill. --

Signed and Sealed this

Fifth Day of February, 1991

*Attest:*

HARRY F. MANBECK, JR.

*Attesting Officer*

*Commissioner of Patents and Trademarks*